US007486236B2

(12) United States Patent
Sarehraz et al.

(10) Patent No.: US 7,486,236 B2
(45) **Date of Patent: *Feb. 3, 2009**

(54) HIGH-FREQUENCY FEED STRUCTURE ANTENNA APPARATUS AND METHOD OF USE

(75) Inventors: Mohammad Sarehraz, Fargo, ND (US); Kenneth A. Buckle, Tampa, FL (US); Elias Stefanakos, Tampa, FL (US); Thomas Weller, Lutz, FL (US); D. Yogi Goswami, Gainsville, FL (US)

(73) Assignee: University of South Florida, Tampa, FL (US)

( * ) Notice: Subject to any disclaimer, the term of this patent is extended or adjusted under 35 U.S.C. 154(b) by 115 days.

This patent is subject to a terminal disclaimer.

(21) Appl. No.: 11/534,800

(22) Filed: Sep. 25, 2006

(65) Prior Publication Data

US 2007/0069965 A1 Mar. 29, 2007

Related U.S. Application Data

(60) Provisional application No. 60/720,296, filed on Sep. 23, 2005, provisional application No. 60/720,331, filed on Sep. 23, 2005.

(51) Int. Cl.
*H01Q 1/38* (2006.01)
*H01Q 13/10* (2006.01)
*H01Q 13/00* (2006.01)

(52) U.S. Cl. ..... 343/700 MS; 343/771; 343/785

(58) Field of Classification Search ..... 343/700 MS, 343/770, 771, 772, 785
See application file for complete search history.

(56) References Cited

U.S. PATENT DOCUMENTS

| | | | | |
|---|---|---|---|---|
| 3,589,177 | A * | 6/1971 | Merlo | 73/116 |
| 6,756,936 | B1 * | 6/2004 | Wu | 342/175 |
| 6,868,258 | B2 * | 3/2005 | Hayata et al. | 455/81 |
| 7,283,704 | B2 * | 10/2007 | Furuya et al. | 385/37 |
| 7,362,273 | B2 * | 4/2008 | Sarehraz et al. | 343/700 MS |
| 2007/0096990 | A1 * | 5/2007 | Sarehraz et al. | 343/700 MS |
| 2007/0240757 | A1 * | 10/2007 | Ren et al. | 136/256 |

* cited by examiner

*Primary Examiner*—Shih-Chao Chen
(74) *Attorney, Agent, or Firm*—Smith & Hopen, P.A.; Molly Sauter

(57) ABSTRACT

An antenna apparatus for the reception of, and or transmission of, electromagnetic energy, the apparatus including a non-radiating dielectric waveguide aperture coupled to at least one dielectric rod antenna, which is electromagnetically coupled to a transmission line element.

16 Claims, 5 Drawing Sheets

HIGH-FREQUENCY FEED STRUCTURE ANTENNA APPARATUS AND METHOD OF USE

CROSS REFERENCE TO RELATED APPLICATIONS

This application claims priority to currently pending U.S. Provisional Patent Application No. 60/720,296, entitled, "A High Frequency Feed Structure Applicable to a Single Antenna or an Array", filed Sep. 23, 2005 and to currently pending U.S. Provisional Patent Application No. 60/720,331, entitled, "A Dual Polarized Feed Structure Applicable to a Single Antenna or an Array", filed Sep. 23, 2005.

STATEMENT OF GOVERNMENT INTEREST

This invention was made with Government support under Grant No. 2106369 LO awarded by the NASA/FSEC. The Government has certain rights in the invention.

BACKGROUND OF THE INVENTION

Light energy is characterized by a dual nature both from a quantum point of view as photons and from a wave point of view as randomly polarized electromagnetic radiation with a wavelength between 400 nm and 700 nm. If the ultraviolet and infrared portion of the spectrum is included, the range of wavelengths is extended at both extremes. Presently, all practical solar cell energy collection schemes utilize the photon nature of light. For example, the conversion of solar energy to electrical energy using the photovoltaic effect depends upon the interaction of photons with energy equal to or greater than the band-gap of the rectifying material. With continued research, the maximum amount of energy captured using the photovoltaic mechanism is estimated to be around 30%.

Optical rectennas are known in the art for harvesting solar energy and converting it into electric power. Optical rectennas consist of an optical antenna to efficiently absorb the incident solar radiation and a high-frequency metal-insulator-metal (MIM) tunneling diode that rectifies the AC field across the antenna, providing DC power to an external load. The combination of a rectifying diode at the feedpoints of a receiving antenna is often referred to as a rectenna. Utilizing a rectenna to harvest solar energy relies upon the electromagnetic nature of radiation and is not limited by the band-gap of the rectifying material. As such, this method is not fundamentally band-gap limited. At microwave frequencies (~2.4 GHz) the rectenna approach has been demonstrated to be approximately 90% efficient. Rather than generating electron-hole pairs as in the photovoltaic method, the electric field from an incident electromagnetic radiation source will induce a wave of accelerated electric charge in a conductor. Efficient collection of the incident radiation is then dependent upon resonance length scales and impedance matching of the collecting antenna to the rectifying diode to minimize losses. However, prior art methods of harvesting high-frequency radiation utilizing rectennas have identified several key problems with the approach. These problems include impedance matching, rectification, polarization, limited bandwidth and captured power.

Recent developments in nanotechnology and manufacturing have led to the re-examination of the rectenna concept for solar energy collection. Two fundamental physical limitations of the rectennas known in the art are skin effect resistance and very low voltage per antenna element.

Traditionally, the $\lambda/2$ dipole antenna is the most commonly used antenna by the designer as the receiving device for a rectenna due to the straightforward design procedure and the ease of fabrication as a printed circuit antenna. However, the $\lambda/2$ dipole has shortcoming as an antenna for an optical detector. A $\lambda/2$ dipole antenna only supports a single polarization. It exhibits a relatively low gain, it exhibits very high conductor losses at higher frequencies and its radiation pattern is omni-directional. It has been shown that the rectifier efficiency would be less than 0.1% for the calculated power at the terminal of a rectenna utilizing a $\lambda/2$ dipole antenna.

Accordingly, what is needed in the art is an improved rectenna for the collection of electromagnetic energy and more particularly an improved rectenna for the collection of solar energy that overcomes the identified deficiencies in the prior art solutions.

SUMMARY OF INVENTION

The present invention provides for the collection of electromagnetic energy through an antenna element and a non-radiating dielectric waveguide (NRD) and the subsequent extraction of energy from the NRD through another aperture to either a micro-strip or other waveguide.

In accordance with the present invention, an antenna apparatus for the reception of, and or transmission of, electromagnetic energy is provided. The antenna apparatus includes a non-radiating dielectric waveguide, having a first conductive plate with a first aperture and a second conductive plate with a second aperture, the first conductive plate and the second conductive plate arranged substantially parallel to each other at a predetermined distance, and a dielectric strip element with a length direction positioned between the first conductive plate and the second conductive plate and a transmission line element, the transmission line element electromagnetically coupled to the second aperture of the non-radiating dielectric waveguide. The first aperture in the non-radiating dielectric waveguide in accordance with this embodiment performs as a slot antenna and the antenna apparatus is operational as a slotted waveguide antenna.

In an additional embodiment, an antenna element, such as a high-gain dielectric rod antenna, is aperture-coupled to the non-radiating dielectric waveguide through the first aperture.

In another embodiment, a plurality of antenna elements are provided and a plurality of apertures are positioned on the first conductive plate of the dielectric waveguide, each of the plurality of antenna elements aperture is coupled to the non-radiating dielectric waveguide through one of the plurality of apertures.

The transmission line element of the present invention may be an electromagnetic waveguide, or an optical waveguide, depending upon the particular application. Additionally, the transmission line element may further include tuning stubs along its length to adjust the impedance of the line.

In an additional embodiment, the antenna apparatus further includes a rectifier, such as a metal-insulator-metal (MIM) diode in circuit communication with the transmission line to rectify the transmitted energy into a direct current power source.

In a particular embodiment, an antenna apparatus for the conversion of solar energy to direct current power is provided, the apparatus includes a dielectric rod antenna element to receive electromagnetic solar energy, a non-radiating dielectric waveguide, further comprising a first conductive plate having a first aperture and a second conductive plate having a second aperture, the first conductive plate and the second conductive plate arranged substantially parallel to each other at a predetermined distance, and a dielectric strip element having a length direction positioned between the first conductive plate and the second conductive plate, and wherein the dielectric rod antenna is aperture coupled to the non-radiating dielectric waveguide through the first aperture such that the electromagnetic solar energy received by the antenna is transmitted through the non-radiating dielectric waveguide, a transmission line element, the transmission line element electromagnetically coupled to the second aperture of the non-radiating dielectric waveguide, and a rectifier electrically coupled to the transmission line element for rectifying the transmitted electromagnetic solar energy into direct current power.

A method for the reception of electromagnetic energy in accordance with the present invention, include the steps of receiving electromagnetic energy through at least one antenna element, transmitting the received electromagnetic energy from the at least one antenna element through a non-radiating dielectric waveguide and transmitting the electromagnetic energy from the non-radiating dielectric waveguide through a transmission line element. With this method, the antenna element could be a slot antenna formed coincident with the non-radiating dielectric waveguide, or a dielectric rod antenna that is aperture-coupled to the non-radiating dielectric waveguide. The electromagnetic energy that is transmitted through the transmission line may then either be detected or rectified as determined by the particular application of the invention. In a specific embodiment, the electromagnetic energy collected by the antenna is solar energy and the method further comprises rectifying the electromagnetic energy transmitted through the transmission line element to provide direct current power.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

The present invention provides a solution to the problem of the MIM rectifier's poor rectification efficiency. One cause of the poor efficiency in a MIM rectifier is the low level of captured electromagnetic radiation by an antenna operating at high frequencies. While the present invention is applicable with high frequency radiation, the present invention is also useful at much lower frequencies, down to the microwave and RF regions of the electromagnetic spectrum.

An antenna coupled with a high frequency rectifier to harvest electromagnetic energy has numerous applications. Some key features of the present invention include the ability to increase the power at the antenna's terminal as well as decreasing conductor losses in the array feed system by employing a low loss array of high gain antennas. The approach can be employed to increase the efficiency of energy harvesting or as an enhanced detector.

Figure 1:
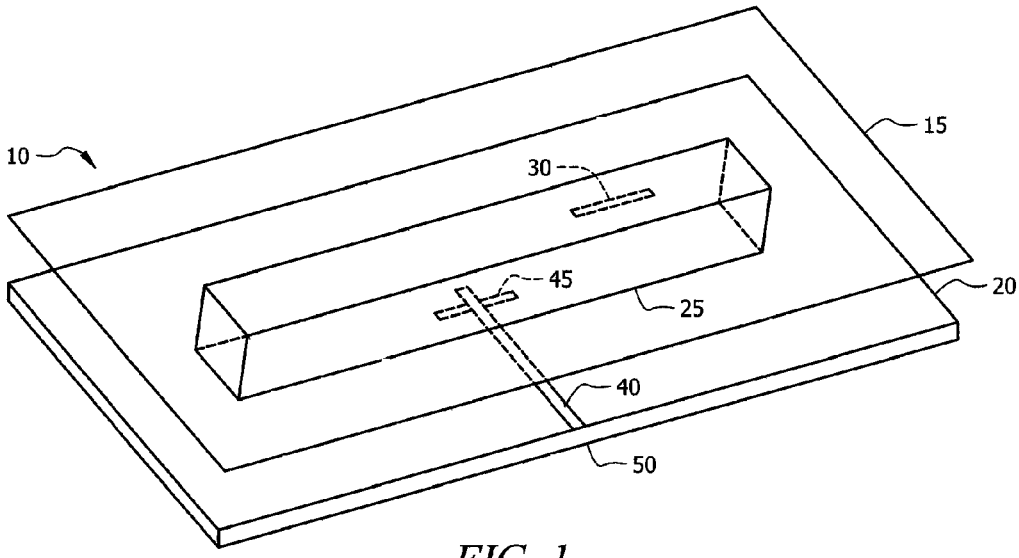
FIG. 1 illustrates an antenna apparatus in accordance with the present invention employing a slot aperture antenna.

With reference to FIG. 1, the antenna apparatus 10 in accordance with the present invention is illustrated, including a non-radiating dielectric waveguide comprising a first conductive plate 15, having a first aperture 30, and a second conductive plate 20, having a second aperture 45. The two plates are arranged substantially parallel to each other at a predetermined distance, and a dielectric strip element 25 having a length direction is positioned between the first conductive plate 15 and the second conductive plate 20. A transmission line element 40 is positioned to be electromagnetically coupled to the second aperture 45. In this configuration, the first aperture is used as a slot antenna and the invention in operable as a slotted waveguide antenna.

Figure 2:
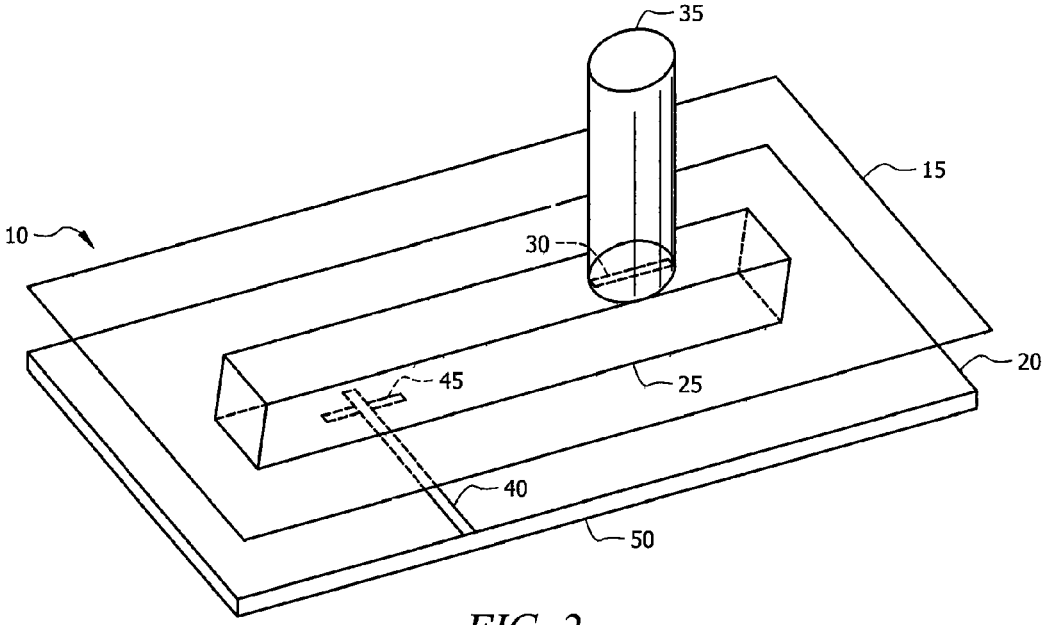
FIG. 2 illustrates an antenna apparatus in accordance with the present invention employing a single dielectric rod antenna.

As shown with reference to FIG. 2, in an additional embodiment of the invention, a dielectric rod antenna 35 is positioned to be aperture coupled with the first aperture 30. The dielectric rod antenna belongs to the family of surface wave antennas. The dielectric rod antenna exhibits high gain and low conductor losses at optical frequencies. However, the invention is not limited to a dielectric rod antenna and other antennas employing aperture coupling feed techniques are within the scope of the present invention.

Figure 6:
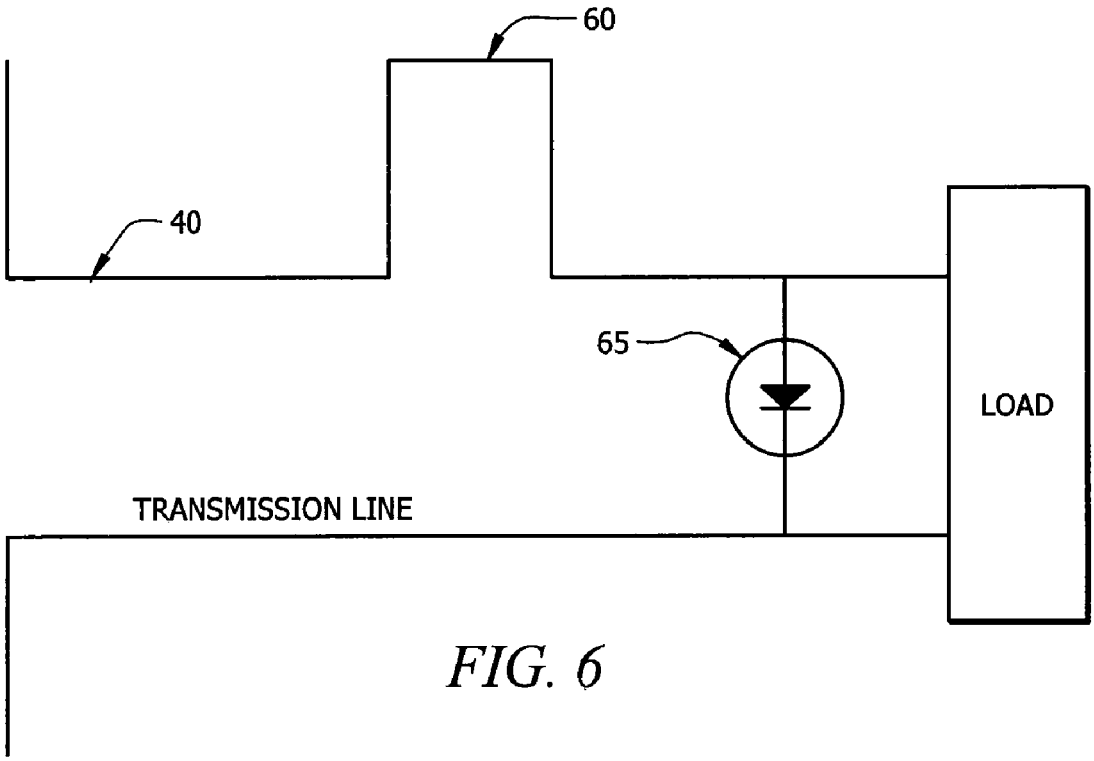
FIG. 6 illustrates a transmission line element including a tuning stub and a rectifier in accordance with an embodiment of the present invention.

The non-radiating dielectric waveguide in accordance with the present invention exhibits low loss and is easy to fabricate. The non-radiating dielectric waveguide consists of a section of dielectric slab 25 sandwiched between two ground planes 15, 20. Since the TE modes at the boundary of the dielectric 25 and air are at a maximum, and at the boundary of the dielectric 25 and conductor 15, 20 are at a minimum, the conductor losses are minimized. The transmission losses of the non-radiating dielectric waveguide consist of the dielectric loss and the conductor loss. The dielectric loss is independent of frequency and the conductor loss decreases as the frequency increases. The non-radiating dielectric waveguide is fed through an aperture 45 in the bottom ground plane 20 by a section of transmission line 40 on a substrate 50. FIG. 6 illustrates the transmission line 40 in more detail. As shown, the transmission line 40 may further include one or more tuning stubs 60 positioned along it's length and a rectifier 65 coupled to the transmission line to harvest the electromagnetic energy captured by the antenna. By changing the position of the transmission line 40 beneath the aperture 45, or by adding tuning stubs 60, the broadband matching of the antenna's 35 impedance to a known reference impedance can be facilitated.

Figure 3A:
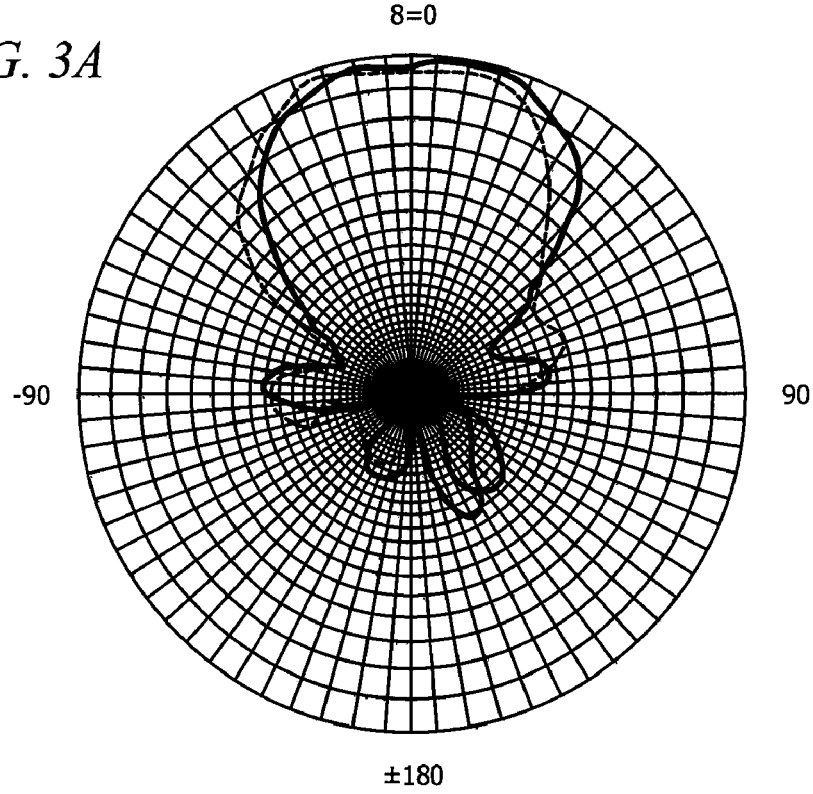
FIG. 3 illustrates the simulated radiation pattern (dashed) and the measured radiation pattern (solid) for the 7 GHz solar antenna in the E field (FIG. 3*a*) and the H field (FIG. 3*b*) in accordance with an embodiment of the present invention employing a single dielectric rod antenna.
Figure 3B:
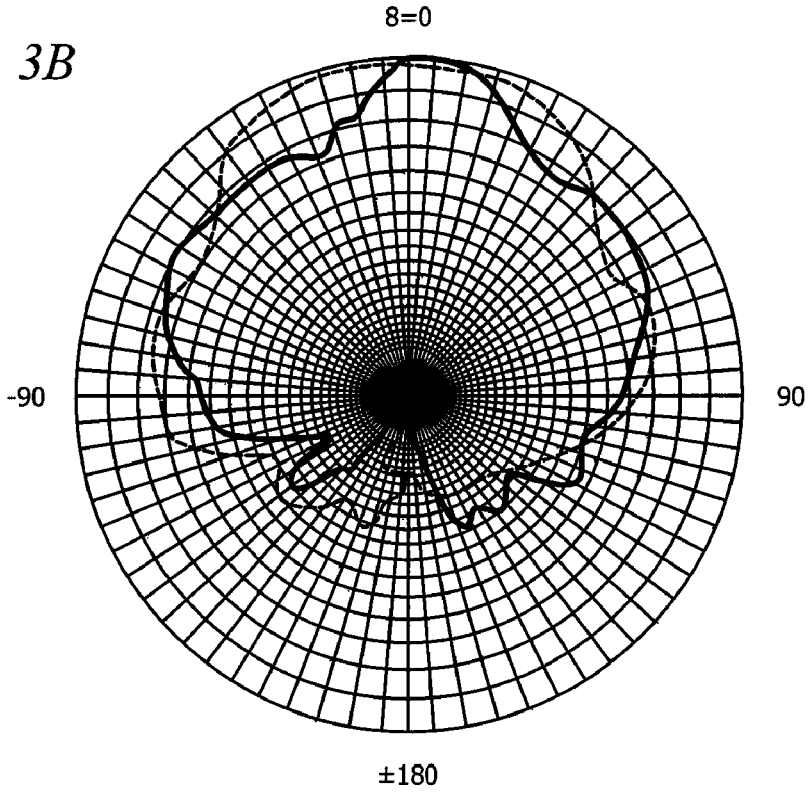

In an exemplary embodiment, the radiation pattern of a 7 GHz antenna apparatus in accordance with the present invention is illustrated with reference to FIG. 3. The half power beamwidth of the antenna apparatus in accordance with this embodiment is approximately 55 degrees, which is in good agreement with the expected theoretical value of 59.4 degrees. The back lobe and the side lobes are 18 dB lower than the main lobe. FIG. 3(*a*) illustrates the simulated radiation pattern (dashed) and the measured radiation pattern (solid)

for the 7 GHz solar antenna in the E field (FIG. 3*a*) and the H field (FIG. 3*b*) in accordance with the present invention.

The power at the terminal of each dielectric rod antenna will be approximately an order of magnitude higher than a $\lambda/2$ dipole antenna as is used in the prior art. In an additional embodiment, a linear array of dielectric rod antennas are utilized to further increase the gain on the antenna apparatus. As shown with reference to FIG. 4, an antenna apparatus 55 have a plurality of antenna elements 35 is illustrated in which a non-radiating dielectric waveguide comprising a first conductive plate 15, having a plurality of apertures 30, and a second conductive plate 20, having a second aperture 45. The two plates are arranged substantially parallel to each other at a predetermined distance, and a dielectric strip element 25 having a length direction is positioned between the first conductive plate 15 and the second conductive plate 20. A transmission line element 40 is positioned to be electromagnetically coupled to the second aperture 45. Again, the advantage of this embodiment of the present invention over the prior art are its high gain, low loss and light weight.

Figure 4:
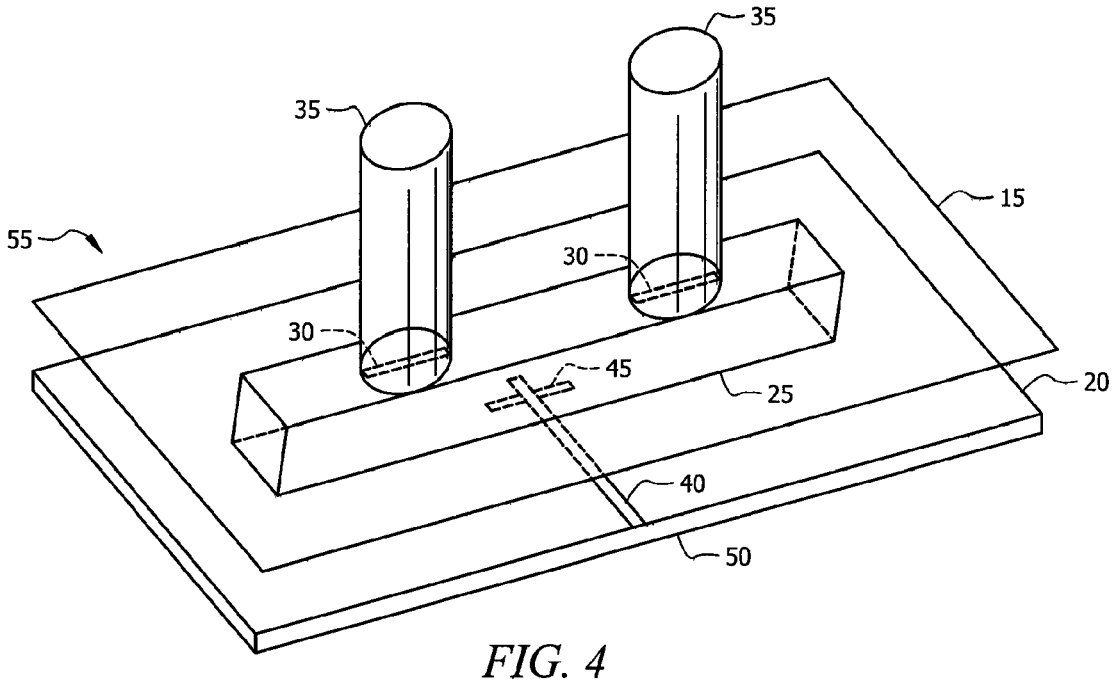
FIG. 4 illustrates an antenna apparatus in accordance with the present invention employing a linear array of dielectric rod antennas.
Figure 5A:
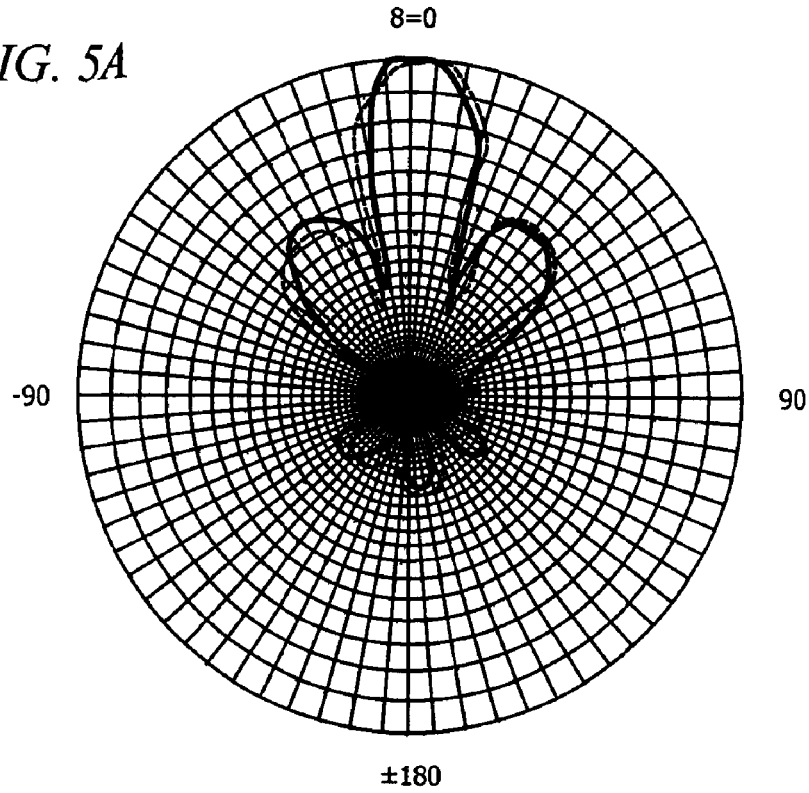
FIG. 5 illustrates the simulated radiation pattern (dashed) and the measured radiation pattern (solid) for the 7 GHz solar antenna in the E field (FIG. 5*a*) and the H field (FIG. 5*b*) in accordance with an embodiment of the present invention employing a linear array of dielectric rod antennas.
Figure 5B:
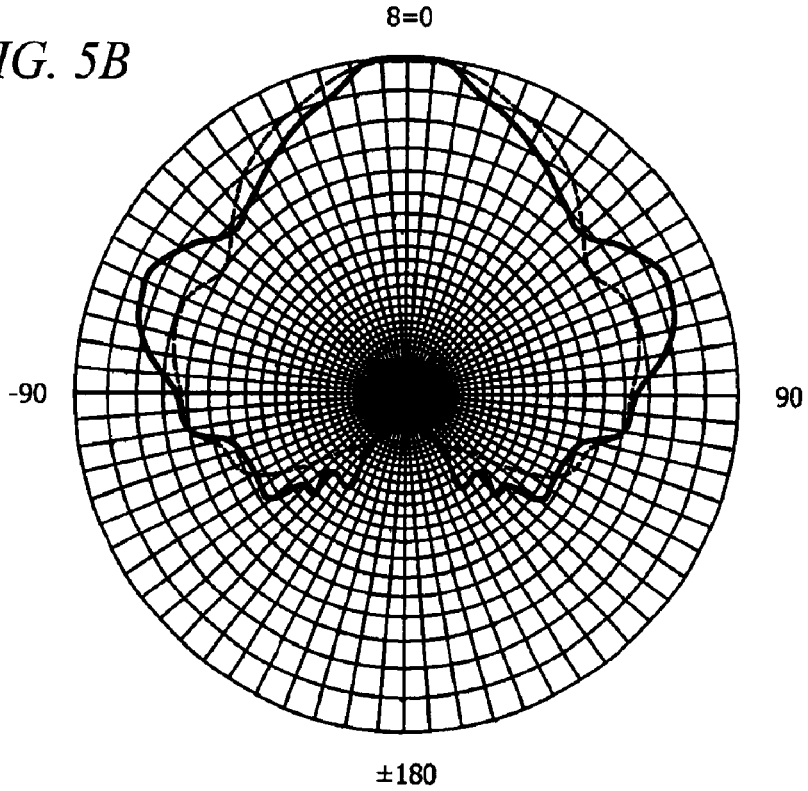

In an exemplary embodiment, an antenna array in accordance with the present invention employing two dielectric rod antennas as shown in FIG. 4 was fabricated at 7 GHz and was linearly polarized. The measurement results of the exemplary antenna array's radiation pattern are presented with reference to FIG. 5. The simulated (dashed) and measured (solid) radiation patterns of the 7 GHz solar array antenna are illustrated in FIG. 5, in which FIG. 5*a* illustrates the E field and FIG. 5*b* illustrates the H field for the exemplary array. As is shown, the half power beamwidth of the prototype is approximately 20 degrees, which is in good agreement with the expected theoretical value of 24 degrees. The side lobes are 12 dB lower than the main lobe. The measured gain of the array was approximately 9.5 $dB_i$, which shows a 3 dB increase in gain as compared to the single dielectric rod antenna element prototype of the present invention. The simulation results and the test results at 7 GHz are convincing evidence that the solar antenna and solar antenna array in accordance with the present invention can improve the MIM rectifier's efficiency by considerably increasing its input power level.

The present invention is not limited to the solar spectrum, but is also viable at much lower frequencies.

As such, the present invention provides an improved antenna array which exhibits high gain and very low conductor losses at optical frequencies. While the antenna apparatus has been detailed with respect to its use at optical frequencies to obtain DC power from a high frequency signal received through an antenna, the invention does not require power rectification and may also be employed as an improved detector.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. An antenna apparatus for the reception of, and or transmission of, electromagnetic energy, the apparatus comprising:

a non-radiating dielectric waveguide, further comprising a first conductive plate having a first aperture and a second conductive plate having a second aperture, the first conductive plate and the second conductive plate arranged substantially parallel to each other at a predetermined distance, and a dielectric strip element having a length direction positioned between the first conductive plate and the second conductive plate and aligned with the first aperture and the second aperture;

a transmission line element, the transmission line element electromagnetically coupled to the second aperture of the non-radiating dielectric waveguide; and a plurality of antenna elements and a plurality of apertures positioned on the first conductive plate of the dielectric waveguide, each of the plurality of antenna elements aperture coupled to the non-radiating dielectric waveguide through one of the plurality of apertures.

2. The apparatus of claim 1, wherein the plurality of antenna elements are dielectric rod antennas.

3. The apparatus of claim 2, wherein the plurality of dielectric rod antennas are high gain antennas.

4. The apparatus of claim 1, wherein the transmission line element is an electromagnetic waveguide.

5. The apparatus of claim 1, wherein the transmission line element is an optical waveguide.

6. The apparatus of claim 1, wherein the transmission line element further comprises at least one tuning stub positioned along its length.

7. The apparatus of claim 1, further comprising a rectifier in circuit communication with the transmission line.

8. The apparatus of claim 7, wherein the rectifier is a metal-insulator-metal rectifier.

9. An antenna apparatus for the conversion of solar energy to direct current power, the apparatus comprising:

a dielectric rod antenna element to receive electromagnetic solar energy;

a non-radiating dielectric waveguide, further comprising a first conductive plate having a first aperture and a second conductive plate having a second aperture, the first conductive plate and the second conductive plate arranged substantially parallel to each other at a predetermined distance, and a dielectric strip element having a length direction positioned between the first conductive plate and the second conductive plate and aligned with the first aperture and the second aperture, and wherein the dielectric rod antenna is aperture coupled to the non-radiating dielectric waveguide through the first aperture such that the electromagnetic solar energy received by the antenna is transmitted through the non-radiating dielectric waveguide;

a transmission line element, the transmission line element electromagnetically coupled to the second aperture of the non-radiating dielectric waveguide;

a rectifier electrically coupled to the transmission line element for rectifying the transmitted electromagnetic solar energy into direct current power; and a plurality of antenna elements and a plurality of apertures positioned on the first conductive plate of the dielectric waveguide, each of the plurality of antenna elements aperture coupled to the non-radiating dielectric waveguide through one of the plurality of apertures.

10. The apparatus of claim 9, wherein the plurality of antenna elements are positioned substantially linearly along the length of the non-radiating dielectric waveguide.

11. A method for the reception of electromagnetic energy, the method comprising the steps of:

receiving electromagnetic energy through a plurality of antenna elements and a plurality of apertures, the plurality of antenna elements and the plurality of apertures positioned on a first conductive plate of a non-radiating dielectric waveguide and each of the plurality of antenna elements aperture coupled to the non-radiating dielectric waveguide through one of the plurality of apertures;

transmitting the received electromagnetic energy from the plurality of antenna elements through the non-radiating dielectric waveguide; and transmitting the electromagnetic energy from the non-radiating dielectric waveguide through a transmission line element.

12. The method of claim 11, wherein the plurality of antenna elements are slot aperture antennas positioned on the non-radiating dielectric waveguide.

13. The method of claim 11, wherein the plurality of antenna elements are dielectric rod antennas.

14. The method of claim 11, further comprising detecting the electromagnetic energy transmitted through the transmission line element.

15. The method of claim 11, further comprising rectifying the electromagnetic energy transmitted through the transmission line element.

16. The method of claim 11, wherein the electromagnetic energy is solar energy and the method further comprises rectifying the electromagnetic energy transmitted through the transmission line element to provide direct current power.

* * * * *